US010881884B1

(12) United States Patent
Siegel

(10) Patent No.: US 10,881,884 B1
(45) Date of Patent: Jan. 5, 2021

(54) DESCENDER WITH FOLDING HANDLE AND INTEGRAL PULLEY

(71) Applicant: Mallory Safety & Supply, LLC, Longview, WA (US)

(72) Inventor: Robert A. Siegel, Waterford, WI (US)

(73) Assignee: MALLORY SAFETY + SUPPLY, LLC, Longview, CA (US)

( * ) Notice: Subject to any disclaimer, the term of this patent is extended or adjusted under 35 U.S.C. 154(b) by 267 days.

(21) Appl. No.: 16/132,851

(22) Filed: Sep. 17, 2018

(51) Int. Cl.
*A62B 1/06* (2006.01)

(52) U.S. Cl.
CPC ..... *A62B 1/06* (2013.01)

(58) Field of Classification Search
CPC ..... A62B 1/14; A62B 1/06; A62B 1/10
USPC ..... 182/5
See application file for complete search history.

(56) References Cited

U.S. PATENT DOCUMENTS 8,100,231 B2 * 1/2012 Petzl ..... A62B 1/14 188/65.5
2004/0149516 A1 * 8/2004 Kwak ..... A62B 1/14 182/5
2006/0090963 A1 * 5/2006 Liao ..... A62B 1/14 182/193
2014/0262611 A1 * 9/2014 Oddou ..... A62B 1/14 182/5
2016/0287913 A1 * 10/2016 Bell ..... A62B 1/14
2018/0340592 A1 * 11/2018 Truesdell ..... F16G 11/146
2019/0351264 A1 * 11/2019 Ratalino ..... A62B 1/14

FOREIGN PATENT DOCUMENTS

WO WO-2006066417 A1 * 6/2006 ..... A62B 1/10
WO WO-2018131038 A1 * 7/2018 ..... A62B 1/14

* cited by examiner

*Primary Examiner* — Alvin C Chin-Shue
(74) *Attorney, Agent, or Firm* — Donald J. Ersler

(57) ABSTRACT

A descender with folding handle and integral pulley preferably includes a base plate, a cover plate, a folding handle, a handle cam, a rope cam, an euler, an integral pulley and at least one spacer. The folding handle includes a base handle portion, a folding handle portion, handle pivot pin and a biasing device. The rope cam includes an inner profile, an outer perimeter, a pivot hole and a rope groove. The pivot hole is formed through rope cam to receive a spacer post. The euler includes a round diameter and a pair of D-shaped projections extending from opposing ends of the round diameter. D-shaped openings are formed in the base and cover plates to receive the D-shaped projections. The integral pulley preferably includes a pulley bracket, a spring clip, a rope pulley and a pulley axle. The rope pulley includes a peripheral groove for retaining a rope.

6 Claims, 4 Drawing Sheets

DESCENDER WITH FOLDING HANDLE AND INTEGRAL PULLEY

BACKGROUND OF THE INVENTION

1. Field of the Invention

The present invention relates generally to rescues from elevated structures and more specifically to a descender with folding handle and integral pulley, which includes a handle that does not have to be angled away from a descender body.

2. Discussion of the Prior Art

It appears that the prior art does not teach or suggest a descender with a folding handle to prevent having to angle a handle away from a descender body; an integral pulley for reducing rope wear; or a replaceable euler and rope cam for accommodating different size ropes. An angled handle provides less leverage than a handle, which is parallel to the base plate of a descender.

Accordingly, there is a clearly felt need in the art for a descender with folding handle and integral pulley, which includes a handle that does not have to be angled away from a descender body; an integral pulley for reducing rope wear; or a replaceable euler and rope cam for accommodating different size ropes.

SUMMARY OF THE INVENTION

The present invention provides a descender with folding handle and integral pulley, which includes an integral pulley for reducing rope wear. The descender with folding handle and integral pulley (descender) preferably includes a base plate, a cover plate, a folding handle, a handle cam, a rope cam, an euler, an integral pulley and at least one spacer. The base plate includes a base cam retention portion and a base carabineer retention portion, which extends from an end of the base cam retention portion. The cover plate includes a cover cam retention portion and a cover carabineer retention portion, which extends from an end of the cover cam retention portion. The base carabineer retention portion and the cover carabineer retention portion preferably curve in toward each other. A carabineer hole is formed through the base and cover carabineer retention portions to retain a carabineer. The folding handle includes a base handle portion, a folding handle portion, handle pivot pin and at least one biasing device. The folding handle portion includes a yoke formed on one end and a yoke pivot pin hole formed through yoke. The base handle includes a shaft hole formed through one end and pivot pin hole formed through an opposing end. A reduced thickness is formed on the opposing end of the base handle portion, around the pivot pin hole. The reduced thickness is sized to be received by the yoke. The biasing device is preferably a torsion spring, which is retained on the handle pivot pin to bias the folding handle into a collapsed orientation as shown in the FIGS. 1-6. The handle cam includes a shaft and a cam member. A flat is formed on one end of the shaft and the cam member extends outward from an opposing end of the shaft. The cam includes a curved profile, which extends from an outer diameter of the shaft and a flat surface that extends to about an axis of the shaft.

The rope cam includes an inner profile, an outer perimeter, a pivot hole and a rope groove. The pivot hole is formed through rope cam to receive a spacer post. The spacer post includes a reduced diameter on opposing ends, which are sized to be received by holes in the base and cover plates. The rope groove is formed in the outer perimeter to receive a rope. The rope groove includes a plurality of cross serrations to engage carrier valleys in the rope. The inner profile includes an inward facing projection. To allow a user to descend, an outer edge of the handle cam is placed in contact with an outer edge of the inward facing projection. The rope cam is replaceable for different sized ropes. The euler includes a round diameter and a pair of D-shaped projections extending from opposing ends of the round diameter. D-shaped openings are formed in the base and cover plates to receive the D-shaped projections. The euler is replaceable for different sized ropes.

The integral pulley preferably includes a pulley bracket, a spring clip, a rope pulley and a pulley axle. The pulley bracket includes a base member, a bottom member and a top member. The bottom member extends from a bottom edge of the base member and the top member extends from a top edge of the base member. The bottom member includes an axle hole and an anti-rotation hole. The pulley axle includes reduced diameters on opposing ends. The top hole in the top member includes a reduced diameter axle hole to receive one of the reduced diameters of the pulley axle. The pulley axle also acts as a spacer. The rope pulley includes a peripheral groove for retaining a rope. The spring clip includes a spring base and a spring clip member. The spring base includes a spring base plate and spring wire projection, which extends from a top of the spring base plate. The spring wire projection includes two parallel cross holes. The spring clip member includes a spring wire having a U-shape with two turned-in ends. The two parallel cross holes are located to receive the two turned-in ends of the spring wire. The pulley axle includes a reduced diameter on each end.

Accordingly, it is an object of the present invention to provide a descender, which includes a folding handle, which is not angled away from a descender body.

It is a further object of the present invention to provide a descender, which includes an integral pulley for reducing rope wear.

Finally, it is another object of the present invention to provide a descender, which includes a replaceable euler and rope cam for accommodating different size ropes.

These and additional objects, advantages, features and benefits of the present invention will become apparent from the following specification.

DETAILED DESCRIPTION OF THE PREFERRED EMBODIMENTS

Figure 1:
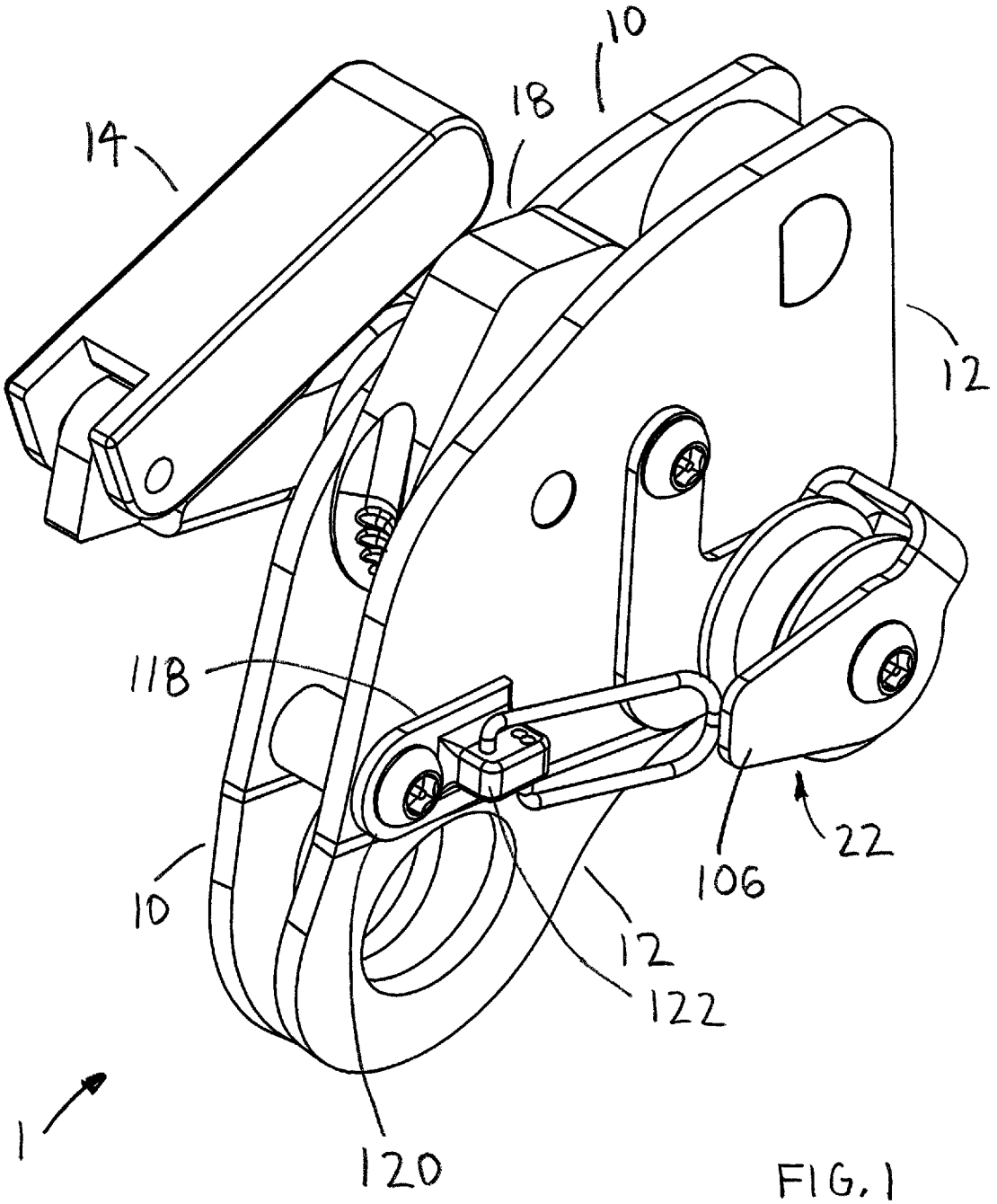
FIG. 1 is a perspective view of a descender in accordance with the present invention.
Figure 2:
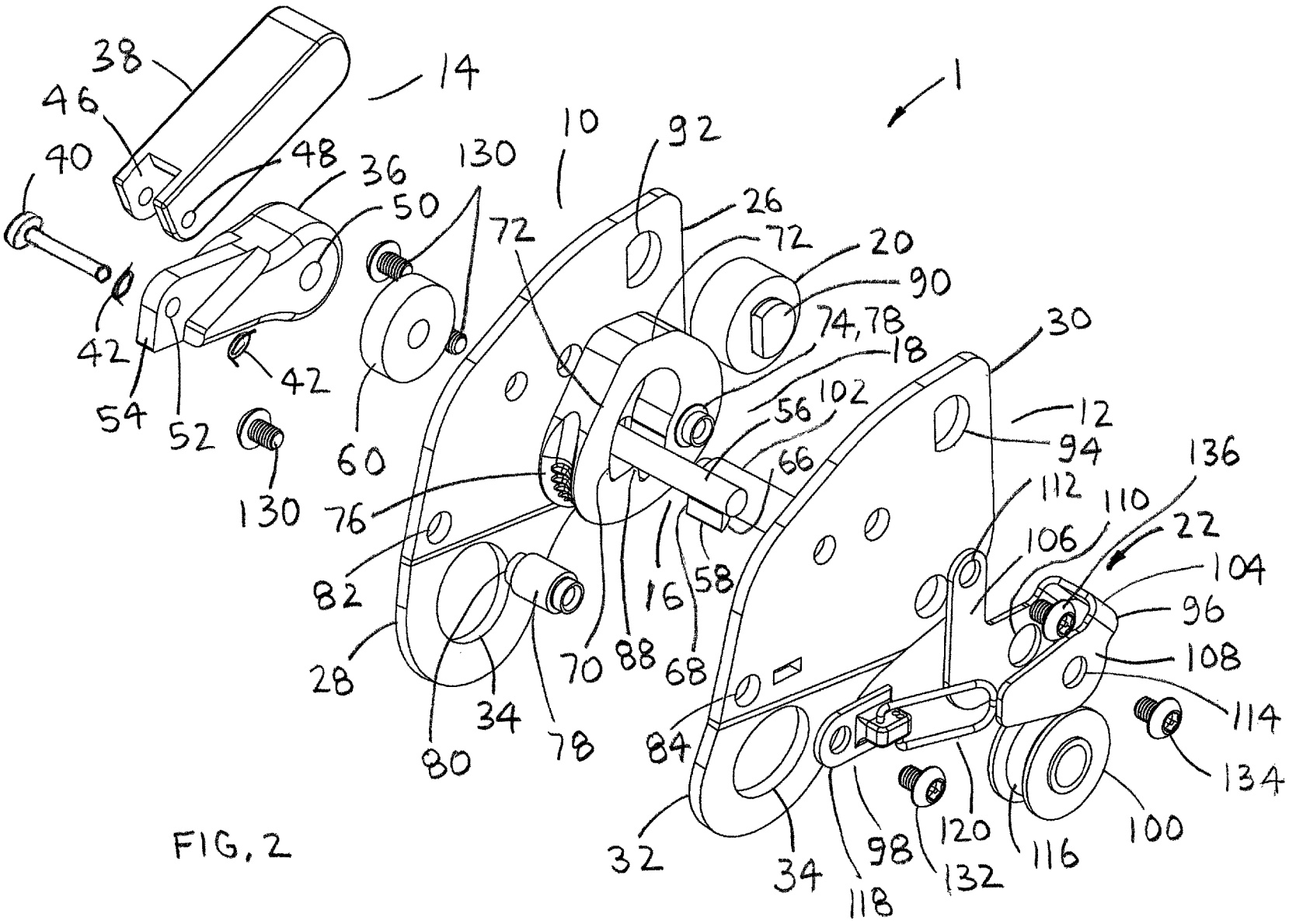
FIG. 2 is an exploded perspective view of a descender in accordance with the present invention.
Figure 5:
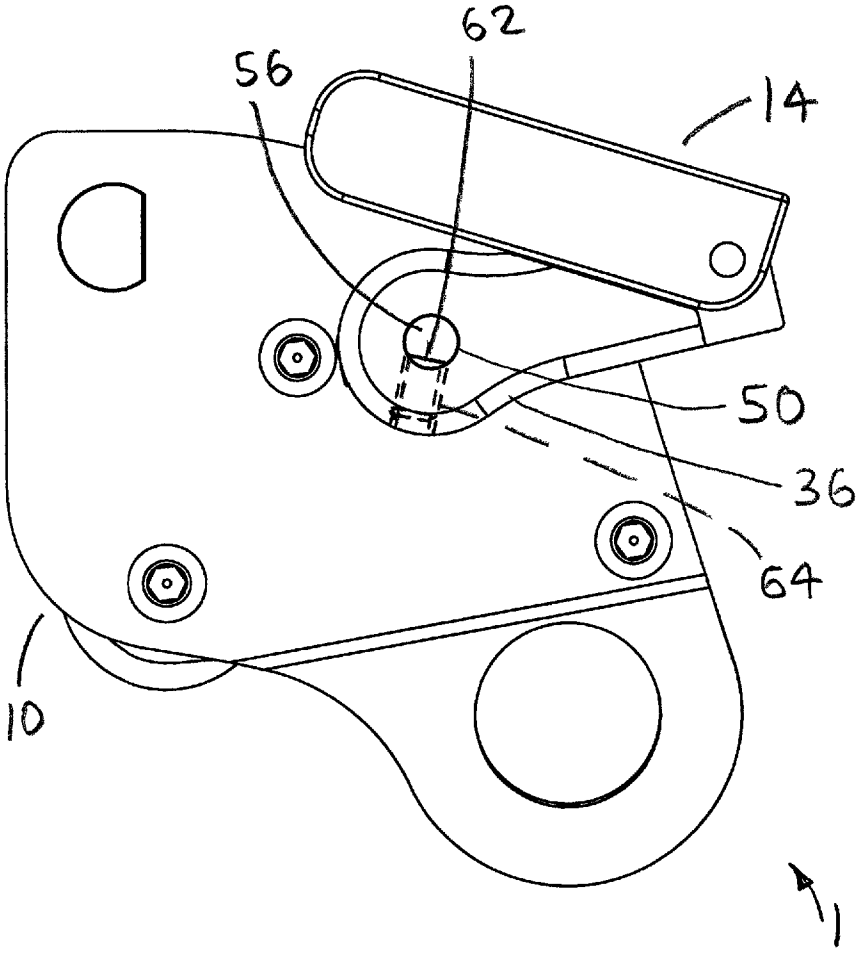
FIG. 5 is a rear view of a descender in accordance with the present invention.

With reference now to the drawings, and particularly to FIG. 1, there is shown a perspective view of a descender 1. With reference to FIG. 2, the descender 1 preferably includes a base plate 10, a cover plate 12, a folding handle 14, a handle cam 16, a rope cam 18, an euler 20, an integral pulley 22 and at least one spacer. The base plate 10 includes a base cam retention portion 26 and a base carabineer retention portion 28, which extends from an end of the base cam retention portion 26. The cover plate 12 includes a cover cam retention portion 30 and a cover carabineer retention portion 32, which extends from an end of the cover cam retention portion 30. The base carabineer retention portion 28 and the cover carabineer retention portion 32 preferably curve in toward each other. A carabineer hole 34 is formed through the base and cover carabineer retention portions 28, 32 to retain a carabineer. The folding handle 14 includes a base handle portion 36, a folding handle portion 38, handle pivot pin 40 and at least one biasing device 42. The folding handle portion 38 includes a yoke 46 formed on one end and a yoke pivot pin hole 48 formed through the yoke 46. The base handle portion 36 includes a shaft hole 50 formed through one end and pivot pin hole 52 formed through an opposing end. A reduced thickness 54 is formed on the opposing end, around the pivot pin hole 52. The reduced thickness 54 is sized to be received by the yoke 46. The at least one biasing device 42 is preferably a torsion spring, which is retained on the handle pivot pin 40 to bias the folding handle 14 into a collapsed orientation as shown in FIGS. 1-6. The handle cam 16 includes a handle shaft 56 and a cam member 58. A handle spacer 60 is retained between the base plate 10 and the base handle portion 36. One end of the handle cam 16 is inserted through the handle spacer 60 and into the shaft hole 50 in the base handle portion 36. With reference to FIG. 5, a flat 62 is formed on one end of the handle shaft 56 and the cam member 58 extends outward from an opposing end of the handle shaft 56. The handle shaft 56 is retained in the shaft hole 50 of the base handle portion 36 with a set screw 64. The cam member 58 includes a curved profile 66, which extends from an outer diameter of the handle shaft 56 and a flat surface 68 that extends to about an axis of the handle shaft 56.

Figure 6:
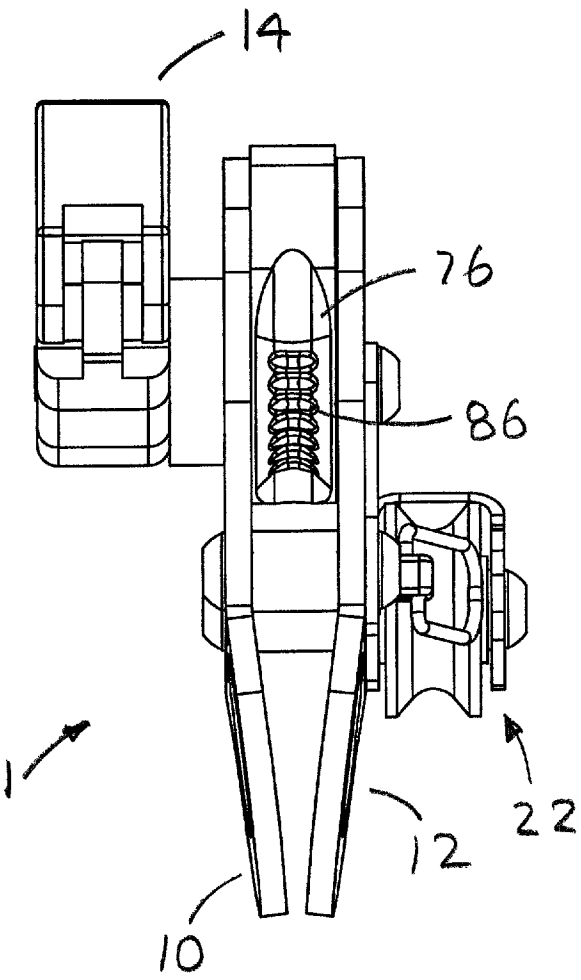
FIG. 6 is a bottom view of a descender in accordance with the present invention.

The rope cam 18 includes an inner profile 70, an outer perimeter 72, a pivot hole 74 and a rope groove 76. The pivot hole 74 is formed through rope cam 18 to receive a spacer post 78. The spacer post 78 includes a reduced diameter 80 on opposing ends, which are sized to be received by holes 82, 84 in the base and cover plates 10, 12, respectively. The rope groove 76 is formed in the outer perimeter 72 to receive a rope (not shown). With reference to FIG. 6, the rope groove 76 includes a plurality of cross serrations 86 to engage carrier valleys in the rope. The inner profile 70 includes an inward facing projection 88. To allow a user to descend, an outer edge of the handle cam 58 is placed in contact with an outer edge of the inward facing projection 88. The rope cam 18 is replaceable for different sized ropes. The euler 20 includes a round diameter and a pair of D-shaped projections extending from opposing ends of the round diameter. D-shaped openings 92, 94 are formed in the base and cover plates 10, 12 to receive the D-shaped projections 92, 94. The euler is replaceable for different sized ropes.

Figure 3:
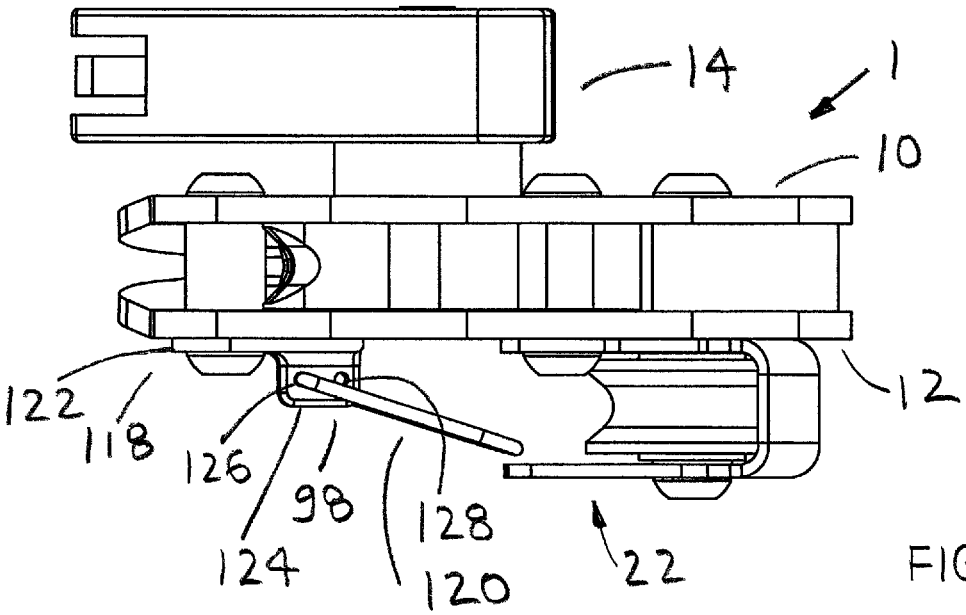
FIG. 3 is a top view of a descender in accordance with the present invention.
Figure 4:
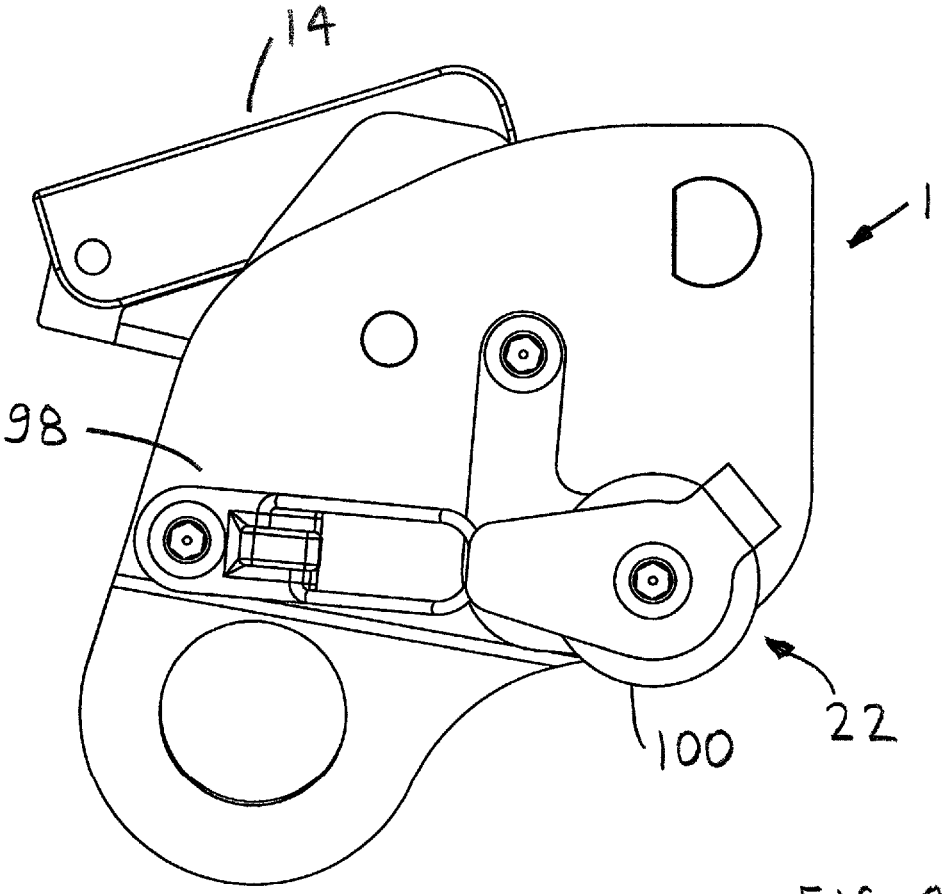
FIG. 4 is a front view of a descender in accordance with the present invention.

The integral pulley 22 preferably includes a pulley bracket 96, a spring clip 98, a rope pulley 100 and a pulley axle 102. The pulley bracket 96 includes a base member 104, a bottom member 106 and a top member 108. The bottom member 106 extends from a bottom edge of the base member 104 and the top member 108 extends from a top edge of the base member 104. The bottom member 106 includes an axle hole 110 and an anti-rotation hole 112. The top member 108 includes a reduced diameter axle hole 114. The rope pulley 100 includes a peripheral groove 116 for retaining a rope. The spring clip 98 includes a spring base 118 and a spring clip member 120. With reference to FIG. 3, the spring base 118 includes a spring base plate 122 and a spring wire projection 124, which extends from a top of the spring base plate 122. The spring wire projection 124 includes two parallel cross holes 126, 128. The spring clip member 120 includes a spring wire having a U-shape with two turned-in ends. The two parallel cross holes 126, 128 are located to receive the two turned-in ends of the spring clip member 120. The pulley axle 102 includes a reduced diameter on each end. The pulley axle 102 also acts as a spacer. The spring clip member 120 is biased against a bottom of the top member 108 to retain a rope in contact with the rope pulley 100.

The descender 1 is preferably assembled by inserting the two spacers 78 into two spacer holes 82 and inserting the euler 20 into the D-shaped opening 92 in the base plate 10. The pivot hole 74 in the rope cam 18 is pushed over one of the two spacers 78. The handle cam 16 is pushed through a hole in the base plate 10. The pulley axle 102 is also pushed into a hole in the base plate 10. The two spacers 78 and the pulley axle 102 are secured to the base plate 10 with three fasteners 130. The handle shaft 56 is inserted through the handle spacer 60 and into the shaft hole 50 in the folding handle 14. The handle 14 is secured on the handle shaft 56 with the set screw 64. The two spacer holes 84 and the D-shaped opening 94 in the cover plate 12 are pushed over the two spacers 78, the euler 20 and the pulley axle 102. A fastener 132 is used to secure the spring clip 98 to one of the two spacers 78. A fastener 134 is used to secure the pulley bracket 96 to the pulley axle 102. A fastener 136 is inserted into the anti-rotation hole 112 to secure the bottom member 106 to a second spacer 78 to prevent rotation of the pulley bracket 96.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

I claim:

1. A descender comprising:

a base plate having a base carabineer opening;

a cover plate having a cover carabineer opening;

a handle cam includes a handle shaft and a cam member, said cam member extends from one end of said handle shaft, an opposing end of said handle shaft is rotatably retained in said base plate;

a rope cam includes an inner profile, an outer perimeter and a rope groove, said inner profile is sized to receive said cam member, said rope cam is pivotally retained between said base and cover plates;

a handle is secured to an opposing end of said handle shaft;

an integral pulley includes a pulley bracket, a spring clip and a rope pulley, said rope pulley is pivotally retained in said pulley bracket, said spring clip is biased against said pulley bracket, said pulley bracket and said spring clip are retained on an outer surface of said cover plate, a pivotal axis of said rope pulley is perpendicular to said outer surface; and an euler is retained between said base plate and said cover plate, adjacent said rope cam.

2. The descender of claim 1, further comprising:

at least one spacer is retained between said base plate and said cover plate.

3. The descender of claim 1, further comprising:

said base plate includes a base cam retention portion and a base carabineer retention portion that extends from an end of said base cam retention portion, said cover plate includes a cover cam retention portion and a cover carabineer retention portion that extends from an end of said cover cam retention portion, said base carabineer opening is formed through said base carabineer retention portion and said cover carabineer opening is formed through said cover carabineer retention portion.

4. The descender of claim 1 wherein:

said inner profile of said rope cam includes an inward facing projection, wherein when an outer edge of said cam member contacts an outer edge of said inward facing projection, a user is able to descend.

5. The descender of claim 1, further comprising:

a plurality of fasteners for removably securing said cover plate to said base plate.

6. The descender of claim 1 wherein:

said rope cam and said euler are replaceable to accommodate different sized ropes.

* * * * *